US011284202B2

(12) United States Patent
Korishe et al.

(10) Patent No.: US 11,284,202 B2
(45) Date of Patent: Mar. 22, 2022

(54) MICROPHONE ASSEMBLY WITH IMPROVED OVERLOAD PERFORMANCE

(71) Applicant: Knowles Electronics, LLC, Itasca, IL (US)

(72) Inventors: Abdulah Korishe, Ishoj (DK); John Nielsen, Hillerod (DK); Jens J. G. Henriksen, Hvidovre (DK)

(73) Assignee: Knowles Electronics, LLC, Itasca, IL (US)

( * ) Notice: Subject to any disclaimer, the term of this patent is extended or adjusted under 35 U.S.C. 154(b) by 16 days.

(21) Appl. No.: 16/858,672

(22) Filed: Apr. 26, 2020

(65) Prior Publication Data

US 2020/0344557 A1 Oct. 29, 2020

Related U.S. Application Data

(60) Provisional application No. 62/840,378, filed on Apr. 29, 2019.

(51) Int. Cl.

| | |
|---|---|
| ***H04R 19/04*** | (2006.01) |
| ***H04R 1/04*** | (2006.01) |
| ***H04R 19/00*** | (2006.01) |
| ***H04R 3/00*** | (2006.01) |

(52) U.S. Cl.

CPC ..... *H04R 19/04* (2013.01); *H04R 1/04* (2013.01); *H04R 3/007* (2013.01); *H04R 19/005* (2013.01); *H04R 2201/003* (2013.01)

(58) Field of Classification Search

CPC ..... H04R 19/04; H04R 1/04; H04R 3/007; H04R 19/005; H04R 2201/003; H04R 3/04; H04R 19/016

See application file for complete search history.

(56) References Cited

U.S. PATENT DOCUMENTS

| | | | | |
|---|---|---|---|---|
| 6,577,187 | B1 * | 6/2003 | Lesko | H03F 1/30 327/307 |
| 2005/0151589 | A1 * | 7/2005 | Fallesen | H03F 1/301 330/259 |
| 2007/0009111 | A1 * | 1/2007 | Stenberg | H04R 19/005 381/113 |
| 2009/0003629 | A1 * | 1/2009 | Shajaan | H04R 1/005 381/113 |
| 2015/0181335 | A1 * | 6/2015 | Florian | H04R 3/02 381/94.1 |
| 2015/0318829 | A1 * | 11/2015 | Astgimath | H03F 3/183 381/120 |
| 2020/0010315 | A1 * | 1/2020 | Tingleff | H03F 3/185 |

* cited by examiner

*Primary Examiner* — Akelaw Teshale

(74) *Attorney, Agent, or Firm* — Loppnow & Chapa; Matthew C. Loppnow; Roland K. Bowler, II

(57) ABSTRACT

The disclosure describes soft limiting electrical signals generated by a transducer before amplification, buffering or other signal conditioning in a microphone assembly, circuits and methods therefor. The soft limiting circuit includes a first circuit portion that limits a first portion of the electrical signal with reduced distortion when the first portion of the signal exceeds a threshold. A second circuit portion of the soft limiting circuit similarly limits a second portion of the electrical signal. In this way, overloading of an amplifier is avoided without excessive distortion.

20 Claims, 3 Drawing Sheets

MICROPHONE ASSEMBLY WITH IMPROVED OVERLOAD PERFORMANCE

FIELD OF THE DISCLOSURE

The present disclosure relates generally to microphone assemblies and more specifically to microphone assemblies having improved overload performance, electrical circuits and methods therefor.

BACKGROUND

Microphones assemblies having a transducer and ASIC disposed in a housing with a host device interface are known generally and deployed in various types of host devices such as cellular phones, headsets, hands free systems, smart televisions, smart speakers, portable computers, etc. Some such microphones include a capacitive microelectromechanical systems (MEMS) transducer that outputs an electrical signal that is buffered or amplified at the frontend of the ASIC before further signal processing and output to the host device. Because the amplitude of the electrical signal is correlative to the intensity of detected sound, loud sounds can cause the electrical audio signal to have large amplitude. However, in these and other microphone assemblies the electrical signals with large amplitude can overload the frontend circuit resulting in a distorted output signal.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are therefore not to be considered limiting of its scope, the disclosure will be described with additional specificity and detail through use of the accompanying drawings.

Figure 1:
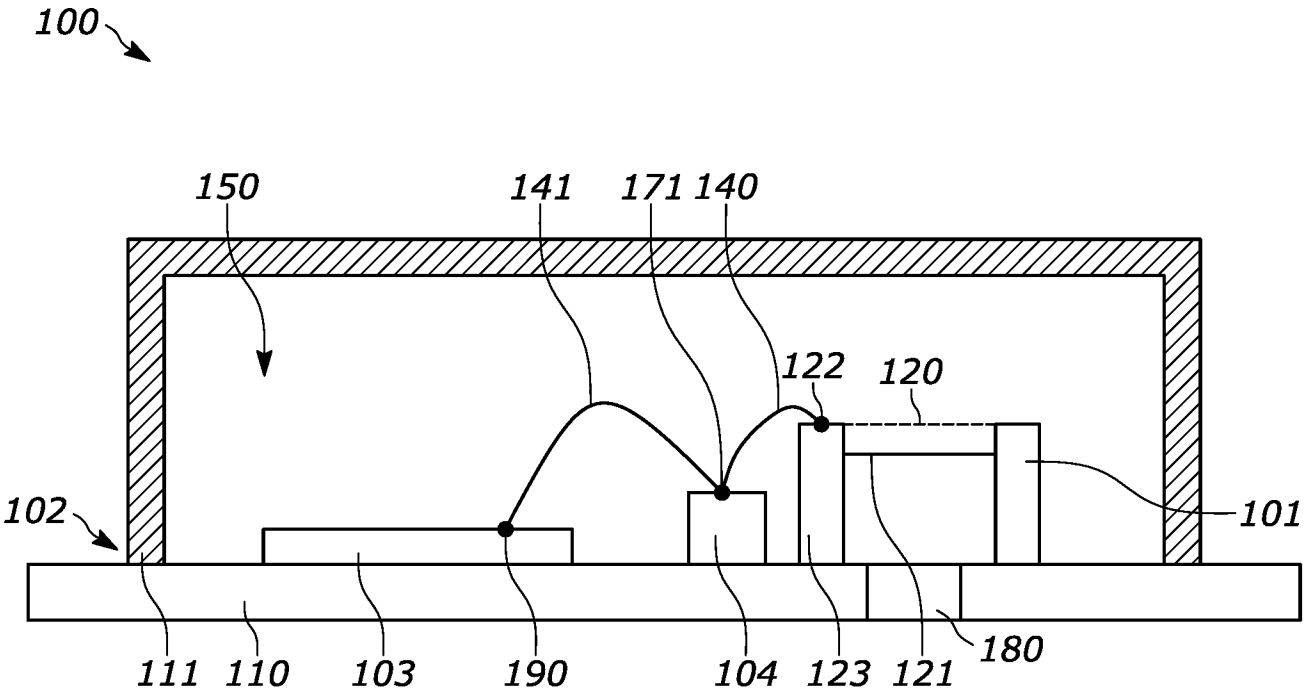
FIG. 1 is a cross-sectional view of a microphone assembly in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The disclosure relates to microphone assemblies having improved overload performance, temperature-compensated electrical signal soft limiting circuits for these and other devices, and methods therefor.

The microphone assembly generally comprises a capacitive transducer electrically coupled to an electrical circuit. The transducer may be embodied as a microelectromechanical systems (MEMS), electret or other transducing device. Generally, the transducer generates an electrical signal representative of an acoustic or other pressure signal sensed thereby and the electrical circuit amplifies, buffers or otherwise conditions the electrical signal before further processing. In implementations where the transducer has high impedance, as is typical of some MEMS transducers, the conditioning circuit is a high impedance buffer.

The electrical circuit and the transducer may be discrete components, for example a MEMS die and an integrated circuit. Alternatively, the transducer and electrical circuit may be integrated on a common substrate, for example, an integrated CMOS/MEMS device. In some implementations, the transducer and electrical circuit are disposed in a microphone assembly housing having a host device interface that includes electrical contacts that facilitate integration with a host device. In other implementations, the transducer and electrical circuit are co-located in or on a host device without enclosure in a microphone assembly housing per se, although in these implementations the transducer and electrical circuit may be enclosed by a housing of the host device. And in still other embodiments the transducer and the electrical circuit of the microphone assembly are not co-located in a single device.

An electrical circuit suitable for use in the microphone assembly implementations described herein generally comprises a soft limiting circuit configured to reduce overload and distortion before the electrical signal is applied to the conditioning circuit. In a more particular implementation, a first circuit portion of the limiting circuit coupled to the input terminal is configured to sink charge from the transducer when a first portion of the electrical signal having a first polarity exceeds a first threshold, and a second circuit portion of the limiting circuit also coupled to the input terminal is configured to sink charge from the transducer when a second portion of the electrical signal having a second polarity, opposite the first polarity, exceeds a second threshold.

According to one aspect of the disclosure, a microphone assembly comprises a capacitive transducer disposed in a housing and configured to generate an electrical signal in response to an acoustic signal, and an electrical circuit disposed in the housing and electrically coupled to the transducer and to contacts of the microphone assembly. The electrical circuit includes a preamplifier having an input terminal electrically coupled to an output of the transducer and configured to buffer or amplify the electrical signal. The electrical circuit also includes a limiting circuit coupled to the input terminal of the preamplifier, wherein a first portion of the limiting circuit is configured to sink charge from the transducer before the electrical signal is applied to the preamplifier when a magnitude of a first portion of the electrical signal having a first polarity exceeds a first threshold, and wherein a second portion of the limiting circuit is configured to sink charge from the transducer before the electrical signal is applied to the preamplifier when a magnitude of a second portion of the electrical signal having a second polarity, opposite the first polarity, exceeds a second threshold. Thus configured, when the first or second threshold is exceeded, the limiting circuit limits the electrical signal before the electrical signal is applied to the preamplifier.

According to a related aspect, in one implementation, the first circuit portion includes a first pair of diodes each having a cathode coupled to a first current source, an anode of one diode of the first pair of diodes coupled to the input terminal and an anode of the other diode of the first pair of diodes coupled to a first reference voltage node, wherein the first current source sinks charge when the magnitude of the first portion of the electrical signal causes conduction of the diode of the first pair of diodes coupled to the input terminal. Similarly, the second circuit portion includes a second pair of diodes each having an anode coupled to a second current source, a cathode of one diode of the second pair of diodes coupled to the input terminal and a cathode of the other diode of the second pair of diodes coupled to a second reference voltage node, wherein the second current source sinks charge when the magnitude of the second portion of the electrical signal causes conduction of the diode of the second pair of diodes coupled to the input terminal. According to another related aspect, the first and second current sources are constant current sources having opposite polarities coupled to ground. The limiting circuit will operate substantially independent of temperature if the diodes are chose to have substantially identical current-voltage characteristics.

According to another aspect of the disclosure, an integrated circuit for use in a microphone assembly including a transducer disposed in a housing having a host device interface with electrical contacts, comprises a conditioning circuit configured to condition an electrical signal produced by the transducer when the conditioning circuit is coupled to the transducer, a first limiting circuit portion configured to limit a first portion of the electrical signal having a first polarity when a magnitude of the first portion of the electrical signal satisfies a first threshold condition, and a second limiting circuit portion configured to limit a second portion of the electrical signal having a second polarity, opposite the first polarity, when a magnitude of the second portion of the electrical signal satisfies a second threshold condition, wherein, when the input terminal of the conditioning circuit is coupled to the transducer and when the first or second threshold condition is satisfied, the electrical signal is attenuated before the electrical signal is applied to the conditioning circuit.

According to a related aspect, in one implementation, the first limiting circuit portion includes a first pair of diodes each having a cathode coupled to a first current source, an anode of one diode of the first pair of diodes coupled to the input terminal and an anode of the other diode of the first pair of diodes coupled to a first reference voltage node, wherein the first current source sinks charge from a transducer coupled to the input terminal when the magnitude of the first portion of the electrical signal causes conduction of the diode of the first pair of diodes coupled to the input terminal, and the second limiting circuit portion includes a second pair of diodes each having a having anode coupled to a second current source, a cathode of one diode of the second pair of diodes coupled to the input terminal and a cathode of the other diode of the second pair of diodes coupled to a second reference voltage node, wherein the second current source sinks charge from a transducer coupled to the input terminal when the magnitude of the second portion of the electrical signal having the second polarity causes conduction of the diode of the second pair of diodes the input terminal. According to another related aspect, the first and second current sources are constant current sources having opposite polarities coupled to ground. The limiting circuit portions circuit will operate substantially independent of temperature if the diodes are chose to have substantially identical current-voltage characteristics.

In FIG. 1 a microphone assembly 100 includes a transducer 101, a housing 102, an integrated circuit 103, and a preamplifier limiting stage 104. While the limiting stage is shown separately, alternatively, it can be an integral part of the integrated circuit 103. The housing 102 includes a base 110 and a cover 111 affixed to the base to define an enclosed volume 150 as is well known in the art. The transducer 101 may be positioned over a port 180 in the housing to allow the transducer to sense the pressure changes within the enclosed volume. The transducer 101 generally includes at least two electrodes 120 and 121, at least one of which mode relative to the other in response to pressure changes.

An output terminal 122 of the transducer 101 is connected to an input terminal 171 of the preamplifier limiting stage 104 via a first wire bond 140. The preamplifier limiting stage is configured to limit the electrical audio generated by the transducer before the electrical signal is applied to the preamplifier to reduce overload and prevent signal distortion. The input terminal 171 is further connected to an input terminal 190 of the integrated circuit 103 via a second lead line 141. In some embodiments, the input terminal 190 of the integrated circuit 103 is also an input terminal of an amplifier (not depicted) located within the integrated circuit. In some embodiments, the preamplifier stage 104 may be integrated within the integrated circuit 103. The integrated circuit may be an application specific integrated circuit (ASIC) or a field-programmable gate array (FGPA) circuit.

Figure 2:
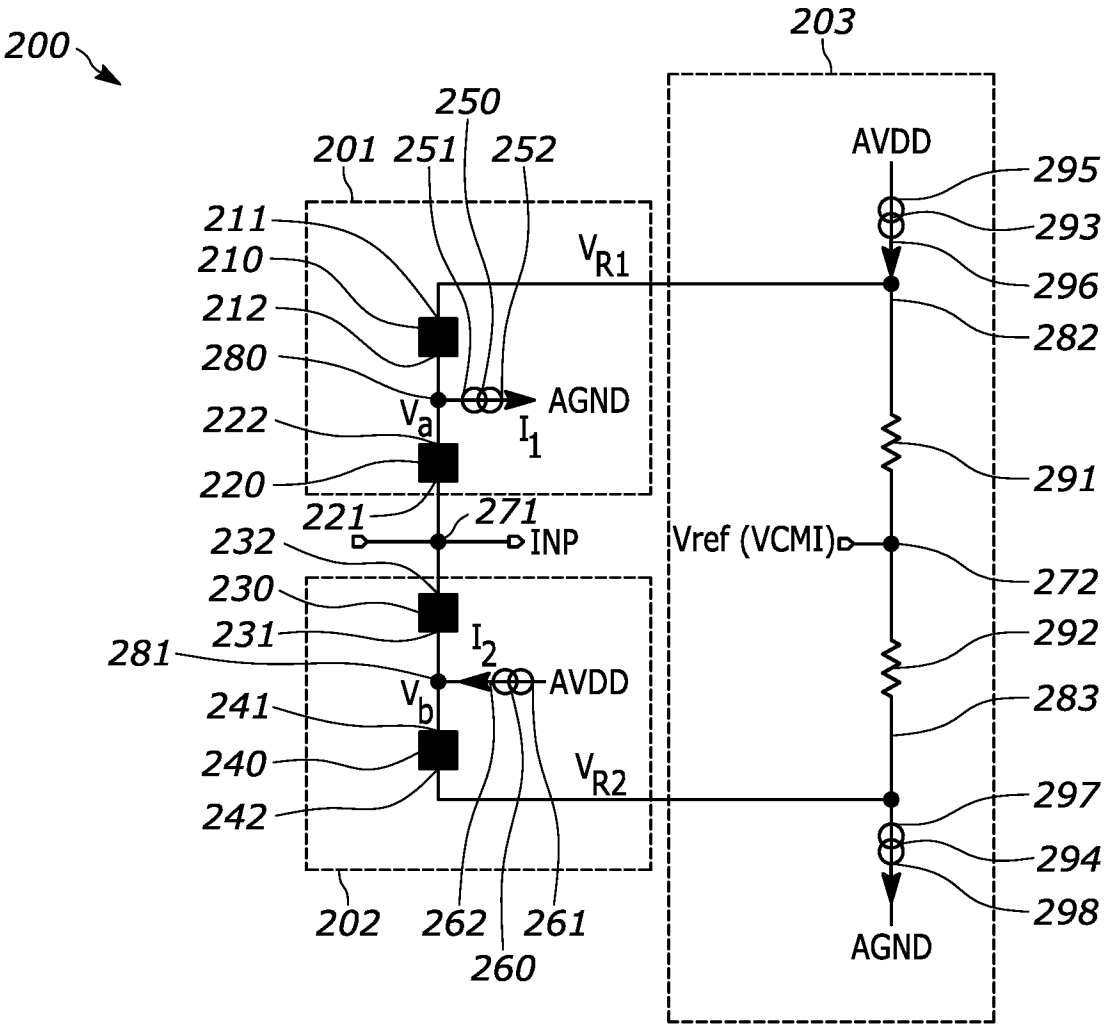
FIG. 2 is a schematic drawing of a limiting circuit in accordance with an illustrative embodiment.

FIG. 2 is a schematic drawing of a preamplifier limiting circuit (e.g., a clipping circuit) 200 including a first limiting circuit portion 201 and a second limiting circuit portion 202, and a reference circuit 203.

The first limiting circuit portion 201 includes a first circuit component 210, a second circuit component 220, and a current source 250. The first circuit component 210 includes an input terminal 211 and an output terminal 212. The second circuit component 220 includes an input terminal 221 and an output terminal 222. The current source 250 includes an input terminal 251 and an output terminal 252.

The output terminal 252 of the current source 250 is connected to ground. The input terminal 251 of the current source 250 is connected to the output terminal 212 of the first circuit component 210 and the output terminal 222 of the second circuit component 220. That is, the output terminal 212 of the first circuit component 210 and the output terminal 222 of the second circuit component 220 are connected and define a junction 280. The input terminal 251 of the current source 250 is connected to the junction 280 and drives a current to ground. In an embodiment, the current source 250 may be a constant current source. The current source 250 may be implemented to be constant using, for example, a constant current diode, or any other known current sources that facilitate a stable current. The current source 250 provides a substantially constant current flow $I_1$ out of the junction 280 to ground. This constant current flow $I_1$ facilitates a constant bias voltage $V_a$ at the junction 280 while also saving power by throttling the amount of current that can flow to ground. That is, the current source 250 ensures that there is never a short between the junction 280 and ground and facilitates the constant bias voltage $V_a$.

The input terminal 212 of the first circuit component 210 is connected to a first reference voltage $V_{R1}$. The input terminal 222 of the second component 220 defines a terminal 271 of the limiting circuit 200. The terminal 271 of the limiting circuit 200 may be then connected to an output of a transducer (not depicted) and an input of an electrical component (e.g., an amplifier). In this way, the first limiting circuit portion 201 limits the positive amplitude of an electrical signal from the transducer (not depicted) and outputs a limited electrical signal into the electrical component (e.g., the amplifier).

The first electrical component 210 and the second electrical component 220 are semiconductor devices that exhibit similar temperature dependent qualities. That is, the first and second electrical components 210 and 220 have substantially the same temperature dependent voltage qualities (e.g., within a particular tolerance of the same characteristics). Further, the first and second electrical components 210 and 220 have a high impedance from the output terminal 212 and 222 to the respective input terminal 211 and 221. In an embodiment, the high impedance includes a resistance that is greater than 40,000 ohms. In alternative embodiments, the resistance may be greater than 200,000 ohms. In an embodiment, the first and second electrical components 210 and 220 are diodes, gate connected metal-oxide-semiconductor field-effect transistor (MOSFETs), a diode equivalent circuit, or any device that has similar characteristics to a diode. The temperature dependent voltage characteristics of the first and second electrical components 210 and 220 ensure that a constant upper limit of an input signal is tracked. That is, the first and second electrical components 210 and 220 exhibit substantially the same current-voltage characteristics as one another at any temperature, which ensures that a corresponding electrical audio signal is limited at a set voltage no matter what the temperature of the device is. An embodiment is explained with specificity below in FIG. 3. In some implementations, similar or the same temperature dependent characteristics may be obtained by using two of the same devices, such as two devices of a same model. In some implementations, two different devices may be used that have similar characteristics.

The second limiting circuit portion 202 includes a third circuit component 230, a fourth circuit component 240, and a second current source 160. The third circuit component 230 includes an input terminal 231 and an output terminal 232. The fourth circuit component 240 includes an input terminal 241 and an output terminal 242. The second current source 160 includes an input terminal 161 and an output terminal 162. The output terminal 232 of the third circuit component 230 is connected to the input terminal 222 of the second circuit component. That is, the output terminal 232 of the third circuit component 230 is connected to the terminal 271 of the limiting circuit. The terminal 271 of the limiting circuit 200 may be then connected to an output of a transducer (not depicted) and an input of an electrical component (e.g., an amplifier). In this way, the second limiting circuit portion 202 limits the negative amplitude of an electrical signal from the transducer (not depicted) and outputs a limited electrical signal into the electrical component (e.g., the amplifier).

The input terminal 231 of the third circuit component 230 is connected to the input terminal 241 of the fourth circuit component 240 and define a second junction 281. The output terminal 162 of second current source 160 is connected to the second junction 281. The input terminal 161 of the second current source 160 is connected to a voltage source $V_{DD}$. In an embodiment, the second current source 160 may be a constant current source. The current source 160 may be a constant current diode, a current-stable non-linear implementation, or any other known current sources that facilitate a stable current. The second current source 160 provides a constant current flow $I_2$ into the second junction 281 from the voltage source $V_{DD}$. This constant current flow $I_2$ facilitates a constant bias voltage $V_b$ at the second junction 281 while also saving power by throttling the amount of current that can flow from the voltage source $V_{DD}$. The output terminal 242 is connected to a second reference voltage $V_{R2}$.

The third electrical component 230 and the fourth electrical component 240 are semiconductor devices that exhibit similar temperature dependent qualities. That is, the third and fourth electrical components 230 and 240 have the same temperature dependent voltage qualities. Further, the third and fourth electrical components 230 and 240 have a high impedance from the output terminal 232 and 242 to the respective input terminal 231 and 241. In an embodiment, the high impedance includes a resistance that is greater than 40,000 ohms. In alternative embodiments, the resistance may be greater than 200,000 ohms. In an embodiment, the first and second electrical components 210 and 220 are diodes, gate connected MOSFETs, a diode equivalent circuit, or any device that has similar characteristics to a diode. The temperature dependent voltage characteristics of the third and fourth electrical components 230 and 240 ensure that a constant upper limit of an input signal is tracked. An embodiment is explained with specificity below in FIG. 2.

The reference circuit 203 includes a first resistor 291, a second resistor 292, a reference current source 293, and a second reference current source 294. In alternative embodiments, the reference circuit 203 may include more or fewer components that facilitate the creation of the reference voltages described below. An input terminal 295 of the reference current source 293 is connected to the voltage source $V_{DD}$ and an output terminal 296 of the reference current source 293 is connected to the first resistor 291. The connection of the output terminal 296 of the reference current source 293 and the first resistor 291 defines a first-reference junction 282. The first-reference junction 282 facilitates the first reference voltage $V_{R1}$. That is, in an embodiment, the input terminal 211 of the first circuit component 210 is connected to the first-reference junction 282. The first resistor 291 is further connected to the second resistor 292 and define an output terminal 272 of the limiting circuit. The output terminal 272 facilitates a stable reference voltage $V_{ref}$ that can be output into a corresponding electrical component (e.g., an amplifier). Further, the stable reference voltage $V_{ref}$ also provides a relative voltage to the output of the transducer (not depicted). That is, the output terminal 272 may also be connected to the transducer (not depicted).

The second resistor 292 is connected to an input terminal 297 of the second reference current source 294 and an output terminal 298 of the second reference current source 294 is connected to ground. That is, in an embodiment, the reference current source 293, the first resistor 291, the second resistor 292, and the second reference current source 294 are all connected in series, in that order. In alternative embodiments, there may only be one current source and the components may be in other configurations. The reference current sources 293 and 294 may be any design known in the art that facilitates constant current.

The connection of the second resistor 292 and the input terminal 297 of the second reference current source 294 define a second-reference junction 283. The second-reference junction 283 facilitates the second reference voltage $V_{R2}$. That is, in an embodiment, the output terminal 242 of the fourth circuit component 240 is connected to the second-reference junction 283. The first and second references voltages $V_{R1}$ and $V_{R2}$ are created at their respective junctions 282 and 283 based on the current flow created from the reference current sources 293 and 294 and the size of the first and second resistors 291 and 292. In an embodiment the first and second resistors have resistances that are equal to one another. That is, in an embodiment, the voltage drop across the first resistor 291 is equal to the voltage drop across the second resistor 292. The reference current sources 293 and 294 may be selectively tuned to ensure that that the references voltages $V_{R1}$, $V_{R2}$, and $V_{REF}$ are set at optimal levels for the corresponding electrical component (e.g., the amplifier).

Figure 3:
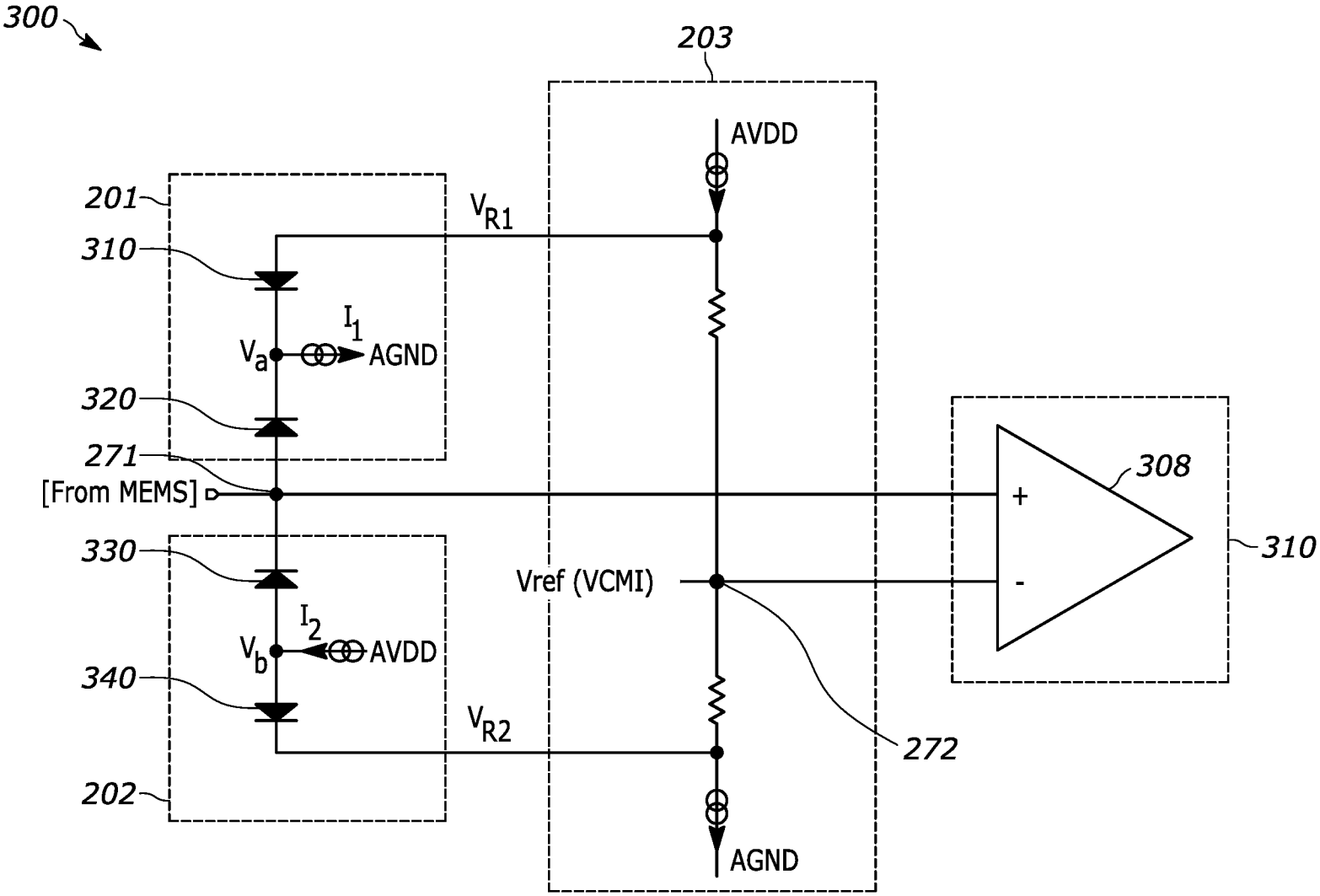
FIG. 3 is a schematic drawing of a limiting circuit and an amplifier in accordance with an illustrative embodiment.

FIG. 3 is a schematic drawing of a limiting circuit with an amplifier 300 configured to buffer, amplify or otherwise condition an electrical signal from the transducer. FIG. 3 is similar to FIG. 2 in that the structure is relatively similar. In FIG. 3, diodes 310, 320, 330, and 340 are inserted for the first, second, third, and fourth circuit components 210, 220, 230, 240. In an embodiment, the diodes are all of the same type. As explained above, in alternative embodiments, the first, second, third, and fourth circuit components 210, 220, 230, 240 may be any semiconductor devices or circuits that exhibit similar temperature, voltage, and current qualities as a diode (e.g., gate connected transistors). The terminal 271 (and electrical signal) is then output into an amplifier 308 of an integrated circuit 310. The output terminal 272 (and $V_{REF}$) is also output to the amplifier.

The similar temperature dependent qualities between the first diode 310 and the second diode 320 ensures that the positive portion of an input signal (e.g., output signal from a transducer) is limited at a constant voltage. Further, the diodes allow for a capacitance of the transducer (not depicted) to be unloaded (i.e., charge is drawn from the transducer) without greatly effecting the reference voltage. For example, the output of an electrical signal from a transducer (not depicted) is entered at the terminal 271 of the limiting circuit. When the electrical signal is small (i.e., the transducer is sensing low volume sound), the second diode 320 is reverse biased and exhibiting a high impedance. Thus, the electrical signal is unaffected by the limiting circuit and input to the amplifier 308 without being attenuation.

However, when the electrical signal is large (i.e., the transducer is sensing loud sounds), the amplitude (e.g., 300-400 mV) of the electrical signal exceeds the constant bias voltage bias voltage $V_a$ the second diode 320 will be forward biased and begin to conduct a portion of the constant current flow $I_1$ without causing the first diode 310 to stop conducting. In this state, the second diode 320 is discharging the current from the transducer. Thus, as the current is discharged (i.e., charge is drawn from the transducer), the voltage begins to drop non-linearly (e.g., in an exponential decay manner) which results in the electrical signal to be limited (as opposed to harshly clipped, which causes significant distortion). The limited electrical signal can then be output to an amplifier and the perceived quality of the loud, amplified sound is greatly increased. The perceived quality is greatly increased because of the decrease in the amount of distortion.

Further, because the current-voltage qualities of the first diode 310 and the second diode 320 are similar the limiting level (e.g., the voltage at which the second diode 320 begins to conduct) is substantially constant over temperature. That is, the voltage bias voltage $V_a$ is temperature dependent based on the temperature coefficient of the first diode 310. However, since the second diode 320 has the same temperature coefficient, the second diode 320 will begin to conduct at a constant amplitude level of the electrical signal. Thus, resulting in increased audio performance.

The second limiting circuit portion 202 exhibits similar benefits for the negative portion of the electrical signal. For example, when an amplitude of the electrical signal gets too low (e.g., −300 to −400 mV) then the third diode 330 will begin to conduct and a portion of the constant current flow $I_2$ will begin to flow into the terminal 271 and the transducer. Similar to above, the capacitive nature of the transducer will begin to take in the current and thereby increase the voltage in a non-linear manner. The non-linear limiting of the negative portions of the electrical signal also increases the perceived quality of the sound and a decreases the distortion. The third and fourth diodes 330 and 340 also have similar temperature coefficients. Thus, for similar reasons above, will cause the electrical signal to be limited at a constant (negative) electrical signal level. Thus, increasing the overall quality, reliability, and overload qualities of the microphone assembly.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A transducer assembly comprising:

a housing having a host device interface with electrical contacts;

a transducer disposed in the housing and configured to generate an electrical signal in response to a sensed signal;

an integrated circuit disposed in the housing and electrically coupled to the electrical contacts, the integrated circuit comprising:

a conditioning circuit having an input terminal electrically coupled to an output of the transducer, the conditioning circuit configured to buffer or amplify an electrical signal produced by the transducer; and a soft limiting circuit coupled to the input terminal of the conditioning circuit, the soft limiting circuit comprising:

a first circuit portion coupled to the input terminal and configured to sink charge from the transducer before the electrical signal is applied to the conditioning circuit when a magnitude of a first portion of the electrical signal having a first polarity exceeds a first threshold; and a second circuit portion coupled to the input terminal and configured to sink charge from the transducer before the electrical signal is applied to the conditioning circuit when a magnitude of a second portion of the electrical signal having a second polarity, opposite the first polarity, exceeds a second threshold, wherein, when the first or second threshold is exceeded, the soft limiting circuit limits the electrical signal, before the electrical signal is applied to the preamplifier conditioning circuit.

2. The transducer assembly of claim 1, the first circuit portion includes a first pair of diodes each having its cathode coupled to a first current source, an anode of one diode of the first pair of diodes coupled to the input terminal and an anode of the other diode of the first pair of diodes coupled to a first reference voltage node, wherein the first current source sinks charge when the magnitude of the first portion of the electrical signal causes the diode of the first pair of diodes coupled to the input terminal to conduct, the second circuit portion includes a second pair of diodes each having its having anode coupled to a second current source, a cathode of one diode of the second pair of diodes coupled to the input terminal and a cathode of the other diode of the second pair of diodes coupled to a second reference voltage node, wherein the second current source sinks charge when the magnitude of the second portion of the electrical signal causes the diode of the second pair of diodes coupled to the input terminal to conduct.

3. The transducer assembly of claim 2, the first pair of diodes having substantially identical current-voltage characteristics and the second pair of diodes having substantially identical current-voltage characteristics, wherein the soft limiting circuit operates substantially independent of temperature.

4. The transducer assembly of claim 3, the first current source is a first constant current source coupled to ground, and the second current source is a second constant current source coupled to ground, wherein a polarity of the first current source is opposite a polarity of the second current source.

5. The transducer assembly of claim 3 further comprising:

a first adjustable current source and a first resistor coupled to the first reference voltage node; and a second adjustable current source and a second resistor coupled to the second reference voltage node, wherein the first threshold is adjustable by adjusting with the first adjustable current source and the second threshold is adjustable by adjusting the second adjustable current source.

6. The transducer assembly of claim 5, the input terminal is a non-inverting input of the conditioning circuit, the first and second resistors coupled to a common reference voltage node coupled to an inverting input of the conditioning circuit.

7. The transducer assembly of claim 1, wherein the transducer is a capacitive microelectromechanical systems (MEMS) transducer having a high impedance and the conditioning circuit includes a preamplifier with a high impedance input terminal.

8. An integrated circuit for a transducer assembly including a transducer disposed in a housing having a host device interface with electrical contacts connectable to the integrated circuit, the integrated circuit comprising:

a conditioning circuit having an input terminal electrically connectable to the transducer, the conditioning circuit configured to condition an electrical signal produced by the transducer when the conditioning circuit is coupled to the transducer;

a first soft limiting circuit portion coupled to the input terminal of the conditioning circuit and configured to limit a first portion of the electrical signal having a first polarity when a magnitude of the first portion of the electrical signal satisfies a first threshold condition; and a second soft limiting circuit portion coupled to the input terminal of the conditioning circuit and configured to limit a second portion of the electrical signal having a second polarity, opposite the first polarity, when a magnitude of the second portion of the electrical signal satisfies a second threshold condition, wherein, when the input terminal of the conditioning circuit is coupled to the transducer and when the first or second threshold condition is satisfied, the electrical signal is attenuated before the electrical signal is applied to the conditioning circuit.

9. The integrated circuit of claim 8, the first soft limiting circuit portion includes a first pair of diodes each having its cathode coupled to a first current source, an anode of one diode of the first pair of diodes coupled to the input terminal and an anode of the other diode of the first pair of diodes coupled to a first reference voltage node, wherein the first current source sinks charge from a transducer coupled to the input terminal when the magnitude of the first portion of the electrical signal causes the diode of the first pair of diodes coupled to the input terminal to conduct charge, and the second soft limiting circuit portion includes a second pair of diodes each having its having anode coupled to a second current source, a cathode of one diode of the second pair of diodes coupled to the input terminal and a cathode of the other diode of the second pair of diodes coupled to a second reference voltage node, wherein the second current source sinks charge from a transducer coupled to the input terminal when the magnitude of the second portion of the electrical signal having the second polarity causes the diode of the second pair of diodes coupled to the input terminal to conduct charge.

10. The integrated circuit of claim 9, the first pair of diodes having substantially identical current-voltage characteristics and the second pair of diodes having substantially identical current-voltage characteristics, wherein the first soft limiting circuit portion and the second soft limiting circuit portion operate substantially independent of temperature.

11. The integrated circuit of claim 10, the first current source is a first constant current source coupled to ground, and the second current source is a second constant current source coupled to ground, wherein a polarity of the first current source is opposite a polarity of the second current source.

12. The integrated circuit of claim 11 further comprising:

a first adjustable current source and a first resistor coupled to the first reference voltage node; and a second adjustable current source and a second resistor coupled to the second reference voltage node, wherein the first threshold condition is adjustable by adjusting the first adjustable current source, and wherein the second threshold condition is adjustable by adjusting the second adjustable current source.

13. The integrated circuit of claim 12, the conditioning circuit is a preamplifier configured to amplify or buffer the electrical signal, the input terminal is a non- inverting input of the preamplifier, the first resistor and the second resistor are both coupled to a common reference voltage node coupled to an inverting input of the preamplifier.

14. The integrated circuit of claim 11, further comprising:

a common reference voltage node;

a first resistor coupled to the first reference voltage node and to the common reference voltage node;

a second resistor coupled to the second reference voltage node and to the common reference voltage node; and a resistance between the common reference voltage node and the first reference voltage node substantially equal to a resistance between the common reference voltage node and the second reference voltage node.

15. The integrated circuit of claim 14, the conditioning circuit is a preamplifier configured to amplify or buffer the electrical signal, wherein the input terminal is a non-inverting input of the preamplifier and the common reference voltage terminal is coupled to an inverting input of the preamplifier.

16. The integrated circuit of claim 8 in combination with a microelectromechanical systems (MEMS) capacitive transducer.

17. A microphone assembly comprising:

a housing having a host device interface with electrical contacts;

an acoustic transducer disposed in the housing and configured to generate an electrical signal in response to acoustic activity;

an integrated circuit disposed in the housing and electrically coupled to the electrical contacts, the integrated circuit comprising:

a preamplifier comprising an input terminal coupled to an output of the acoustic transducer and a reference terminal, the preamplifier configured to amplify or buffer the electrical signal;

a soft limiting circuit comprising:

a first circuit component comprising a first input terminal and a first output terminal;

a second circuit component comprising a second input terminal and a second output terminal; and a first constant current source comprising a third input terminal and a third output terminal, wherein the third output terminal is connected to ground, wherein the first input terminal is connected to a first reference voltage node, and the first output terminal is connected to the second output terminal of the second circuit component and to the third input terminal of the first current source, and wherein the second input terminal of the second circuit component is connected to the input terminal of the preamplifier; and a first resistor connected between the first reference voltage node and a common reference voltage node coupled to the reference terminal of the preamplifier.

18. The microphone assembly of claim 17, wherein the soft limiting circuit further comprises:

a third circuit component comprising a fourth input terminal and a fourth output terminal;

a fourth circuit component comprising a fifth input terminal and a fifth output terminal;

a second constant current source comprising a sixth input terminal and a sixth output terminal, wherein the sixth input terminal is connected to ground, wherein the fourth output terminal of the third circuit component is connected to the input terminal of the preamplifier, the fourth input terminal of the third circuit component is connected to the fifth input terminal of the fourth circuit component, and the fifth output terminal of the fourth circuit component is connected to a second reference voltage node; and a second resistor connected between the second reference voltage node and the common reference voltage node.

19. The microphone assembly of claim 18, wherein the first, second, third and fourth circuit components each comprise a diode.

20. The microphone assembly of claim 19 further comprising a first adjustable current source coupled to the first reference voltage node and a second adjustable current source coupled to the second reference voltage node, wherein a first clipping threshold for a first portion of the electrical signal having a first polarity is adjustable by the first adjustable current source, and wherein a second clipping threshold for a second portion of the electrical signal having a second polarity, opposite the first polarity, is adjustable by the second adjustable current source.

* * * * *